United States Patent [19]

Gardner, Sr.

[11] Patent Number: 4,846,951

[45] Date of Patent: Jul. 11, 1989

[54] PROCESS AND APPARATUS FOR CONTROLLING GASKET FORCE IN ELECTROLYSIS CELLS

[75] Inventor: Gary L. Gardner, Sr., Lake Jackson, Tex.

[73] Assignee: The Dow Chemical Company, Midland, Mich.

[21] Appl. No.: 219,947

[22] Filed: Jul. 15, 1988

[51] Int. Cl.[4] ..... C25B 9/00; C25B 15/00

[52] U.S. Cl. ..... 204/256; 204/258; 204/265; 204/266; 204/270; 204/279

[58] Field of Search ..... 204/253–256, 204/229, 279, 270; 100/99

[56] References Cited

U.S. PATENT DOCUMENTS

| | | | |
|---|---|---|---|
| Re. 32,635 | 4/1988 | Noda et al. | 210/225 |
| 1,273,357 | 7/1918 | Gougnard | 256/41 |
| 2,012,046 | 8/1935 | Jewett | 204/256 |
| 3,236,760 | 2/1966 | Messner | 204/256 |
| 3,432,420 | 3/1969 | Pan | 204/216 |
| 3,981,802 | 9/1976 | Schotten et al. | 210/97 |
| 4,017,375 | 4/1977 | Pohto | 204/255 |
| 4,083,298 | 4/1978 | Schotten | 100/214 |
| 4,273,641 | 6/1981 | Pere | 204/253 |
| 4,279,731 | 7/1981 | Pellegri | 204/256 |
| 4,324,634 | 4/1982 | Kircher et al. | 204/228 |
| 4,430,179 | 2/1984 | Ford et al. | 204/128 |
| 4,451,911 | 9/1985 | Burgess et al. | 204/253 |

OTHER PUBLICATIONS

Pamphlet Solid/Liquid Separation Machinery, Equipment, and Plants, Ritterhaus & Blecher.

Pamphlet FP-8, Hoesch, Black Clawson Filter Subsidiary.

Pamphlet Schriver Filter Presses, EIMCO Process Equipment Company.

Pamphlet Shriver Plate Type Pressure Filters, Envirotech.

Pamphlet Filter Presses, Netzsch.

*Primary Examiner*—Donald R. Valentine

[57] ABSTRACT

The present invention is directed to a process and apparatus for controlling the pressure load on gaskets of an electrolysis cell by comparing the internal cell pressure to the pressure of the hydraulic fluid to the cell compressor and activating a controller for adjusting the pressure to a set point based on the data obtained by the comparison. The apparatus includes a hydraulic compressor adapted for pressing cell members together, a pressure sensor for measuring the pressure inside the electrolysis cell, a pressure sensor for measuring the pressure in the compressor, and a controller for controlling the amount of hydraulic fluid to and from the compressor.

10 Claims, 1 Drawing Sheet

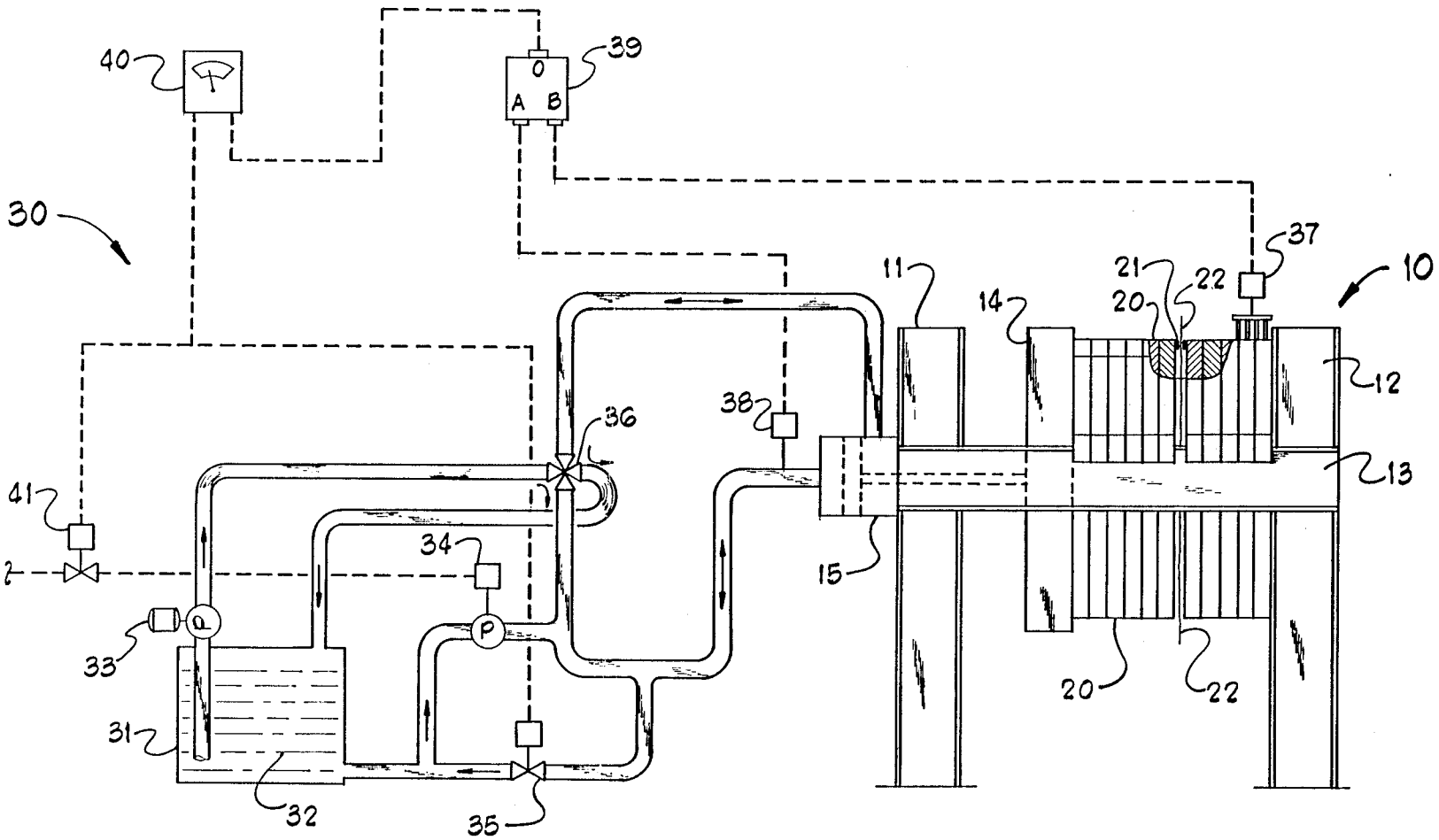
10
12
13
37
22
21
20
22
20
14
11
15
38
39
36
O
B
A
35
34
P
32
40
Q
33
31
30
41

PROCESS AND APPARATUS FOR CONTROLLING GASKET FORCE IN ELECTROLYSIS CELLS

BACKGROUND OF THE INVENTION

This invention relates to a process and apparatus for controlling gasket force in an electrolysis cell.

Electrolytic cells, particularly of the filter press-type, used for the electrolysis of aqueous salt solutions are well known and have been commercially employed for the production of chlorine and caustic from brine. Filter press-type electrolytic cells commonly employ a plurality of frames having electrodes held thereto and assembled in filter press type arrangement, separated from each other by membranes, diaphragms or microporous separators, forming a plurality of anolyte and catholyte compartments. The separators used in filter press-type cells are generally in sheet form and have ion exchange properties. The electrodes used in the cells are generally monopolar or bipolar electrodes.

Typically, a press means such as a hydraulic squeezer unit is used to compress or clamp together the separators in sheet form between the sides of the frame members to form a filter press cell electrolyzer unit. The anolyte and catholyte compartments of the cell are then filled with electrolyte.

Typically, to provide a fluid-tight seal between the frame members of the cell and the separator without damaging the separator, substantially flat, solid gaskets having a rectangular cross sectional area or tubular type gaskets having a circular cross sectional area made of elastomeric materials are disposed between the peripheral flange of the frame members and the separator. One or two gaskets can be installed between the cell frame members on either side of the membrane.

Using the squeezer apparatus such as the hydraulic unit, a set squeeze pressure load on the gaskets is used to obtain a fluid-tight seal in the cells. After operation, if the cells require an additional squeeze pressure to seal the cells, the squeeze pressure is adjusted manually and the cells are squeezed tighter. Oversqueezing the gaskets is a potential problem with increased gasket loads which, in turn, may cause damage to the membrane by thinning of the membrane and subsequent rupture and/or perforation at the thinned area at the edge of the gasket.

When cells run at atmospheric conditions, manual adjustments to the squeeze load on the gaskets are satisfactory because no internal force which opposes the squeeze force is present within the cells. When pressurized cells are used, however, adjusting the squeeze pressure to the right setting to prevent over squeezing the gaskets and damage to the membranes is more critical, particularly when a process upset occurs during operation of the cells. For example, during operation of the cells, if there is a gasket failure and a leak occurs in one compartment there can be a pressure loss in the overall cell structure. If such a pressure loss occurs and there is no system which adjusts to the pressure loss, an excess pressure will be placed on the gaskets. The pressure on the gaskets will, in turn, transfer to the membrane resulting in tearing of the membrane. Membrane tears inevitably lead to a shutdown of the cell operation. Relatively expensive chlorine cell membranes are ruined by application of excessive gasket pressure.

What is needed, therefore, is an automatic control system to balance pressure during operational upsets, startups and shutdowns of the cells. It is desired therefore, to provide a system and process which controls the gasket pressure at a preset value and minimizes membrane damage.

SUMMARY OF THE INVENTION

One aspect of the present invention is directed to a process for controlling the pressure load on gaskets of an electrolysis cell including comparing the internal cell pressure to the pressure of the hydraulic fluid to a compressing means and activating a control means for adjusting the pressure to a set point based on the data obtained by the comparison.

Another aspect of the present invention is directed to an apparatus for controlling the pressure load on gaskets of an electrolysis cell including a compressing means adapted for pressing cell members together, a pressure sensing means for measuring the pressure inside the electrolysis cell, a pressure sensing means for mesuring the pressure exerted by the compressing means, and a control means for controlling the amount of hydraulic fluid to and from the compressing means.

BRIEF DESCRIPTION OF THE DRAWING

The drawing is a side view, partially broken away and partially schematic view showing a squeezer apparatus and a means for controlling the gasket force in the squeezer.

DETAILED DESCRIPTION OF THE PREFERRED EMBODIMENTS

With reference to the drawing, there is shown a hydraulic squeezer unit, generally indicated by numeral 10, with a plurality of filter press type electrolysis cell frame members 20. A gasket 21 and membrane 22 are interposed between the frame members 20. Generally, the squeezer unit 10 includes two stationary platens 11 and 12 with side rails 13 attached thereto and adapted for supporting the frame members 20. A mobile platen 14 is also supported on the side rails 13 and connected to a hydraulic cylinder or plurality of cylinders 15 connected in parallel. The hydraulic cylinder 15 is used to squeeze the frame members 20 together between the stationary platen 12 and its mobile platen 14. A squeezer unit 10 used in the present invention, can be of the type described for example, in U.S. patent Ser. No. 901,924 entitled "Apparatus For Pressure Plate-Type Structures", filed Aug. 29, 1986 by Roy L. Hicks, which is incorporated by reference herein.

A control system, generally indicated by numeral 30, is used for controlling the hydraulic cylinders 15 and the mobile platen 14 and the eventual squeeze pressure on the cell frame members 20. The control system may be electrical, pneumatic, mechanical, hydraulic, electronic or computerized or any combination of the above. In this instance, the control system 30 comprises a reservoir 31 containing hydraulic fluid 32 for feeding into the hydraulic cylinder 15. A pump 33 is used to pump hydraulic fluid from the reservoir 31 to and from the cylinder 15 as needed to provide the main pressure load on the gaskets 21. The main pump 33 is used for large flow of hydraulic fluid such as of oil 32 to and from the hydraulic cylinder 15. The hydraulic cylinder 15 is used to move the platen 14 back and forth as desired, but once this major movement is obtained, the main pump 33 can be shut off and the control system continued by activating a second pump 34. The second pump 34 is used to provide hydraulic fluid from the reservoir 31 to and from the cylinder 15 for pressing the mobile platen 14 against the cell frame members 20 during operation of the cells. A bleed off valve 35 is used to remove hydraulic fluid from the cylinder 15 and passing the fluid to the reservoir 31, thus reducing the pressure on the cell frame members 20 and retracting the mobile platen 14 during operation of the cells. A two-way flow valve 36 is used to reverse the direction of the applied force of the hydraulic cylinder 15.

A pressure sensing means such as a conventional pressure transmitter 37 is mounted to the cell frame members 20 to measure the pressure inside the cell compartments. A second pressure sensing means 38 is mounted on the hydraulic fluid feed conduit to the hydraulic cylinder 15 to measure the pressure in the hydraulic cylinder 15. The pressure sensing means 37 and 38 are in pneumatic communication with a pneumatic computing relay 39 which compares the two pressures and relays the response to a pneumatic controller means and indicator 40 which is at a set pressure point. The controller means 40 is used to pneumatically activate a pressure control valve 41 or the bleed off valve 35 based on the response of the relay means 39. If the output response of the relay means 39 is less than the set pressure point, then the valve 41 is activted to provide more fluid to the cylinder 15 sufficient to increase the pressure on the cell frame members 20 and the gaskets 21. If the output response of the relay means 39 is greater than the set pressure point, then the controller means 40 activates the bleed off valve 35 to remove fluid from the cylinders 15 sufficient to decrease the pressure on the cell frame members 20 and the gaskets 21.

A mathematical equation can be derived to define the system for which the controlling apparatus can be used and to arrive at the desired pressure load on the gaskets. For example, the following equation can be used:

$$P_g = C_1 P_h - C_2 P_i$$

where $P_g$ = gasket squeeze pressure in pounds per square inch $P_h$ = pressure of the hydraulic fluid in the cylinder; pounds per square inch gage (psig)

$P_i$ = pressure inside the cell compartments; psig $C_1$, $C_2$ = constants that are a function of the gasket geometry, the cell geometry, and the hydraulic cylinder geometry.

The above equation can change depending on the gasket, the type of squeezer used, the size of the cell and other variable which one skilled in the art can determine. It is understood that the invention is not limited to a specific equation but can vary as the parameters of the system changes.

The electrolytic cell of the filter press-type formed in the squeezer of the present invention together with the cell's essential components including electrodes (anodes and cathodes) and cell frame members are well known to those skilled in the art. For example, the filter press electrolysis cell described in U.S. Pats. No. 4,488,946 and 4,690,748, incorporated herein by reference, may be used in the present invention.

When a plurality of electrolytic units are assembled in operable combination, membrane is positioned between adjoining electrolytic units. The membrane used in the present invention may be an ion exchange membrane known by those skilled in the art. The ion exchange membrane suitable for use with the present invention may contain a variety of ion exchange active sites. For example, the ion exchange membrane may contain sulfonic or carboxylic acid ion exchange active sites. Optionally, the ion exchange membrane may be a bi-layer membrane having one type of ion exchange active site in one layer and another type of ion exchange active site in the other layer. The membrane may be reinforced to impair deforming during electrolysis or they may be unreinforced to maximize the electrical conductivity through the membrane Representative of the types of ion exchange membrane suitable for use in assemblying a plurality of electrolytic units are disclosed in the following U.S. Pat. Nos.: 3,909,378; 4,025,405; 4,065,366; 4,116,888; 4,123,336; 4,126,588; 4,151,053; 4,176,215; 4,178,218; 4,192,725; 4,209,635; 4,212,713; 4,251,333; 4,270,996; 4,329,435; 4,330,654; 4,337,137; 4,337,211; 4,340,680; 4,357,218; 4,358,412; and 4,358,545. These patents are hereby incorporated by reference for the purpose of the membranes they disclose.

The gasket used in the filter press-type electrolytic cells may be made of conventional rubber or elastomeric materials. Representative of the type of gaskets for use in electrolytic cells are disclosed in the following U.S. Pat. Nos. 4,610,765 and 4,654,134. These patents are hereby incorporated by reference for the purpose of the gaskets they disclose.

The present invention will be better understood with reference to the following example but it is understood that the invention is not intended to be limited thereby.

EXAMPLE

In this example, a pilot size squeezer apparatus with pilot size cell frame members was used. The cell frame members were five by twelve feet. Gaskets made of polytetrafluoroethylene (PTFE) material was used in the cell and one gasket had an area of 402 square inches. An electrolyzer consisting of six cell frame members comprising five cells was used. The internal cell pressure was operated at approximately 15 psig. The following empirical equation was derived for the present example conditions only:

$$P_g = P_h = 20.74\ P_i$$

The above equation was derived from $P_g = C_1 P_h - C_2 P_i$ where $C_1 = 1.00$ and $C_2 = 20.74$.

With reference to the drawing, the hydraulic cylinder pressure transmittter 38 was ranged so that its pneumatic output signal of 3 to 15 psig was proportional to a hydraulic pressure of 0 to 1500 psig. This signal is proportional to $P_h$ in the equation above and is the "A" input to the computing relay 39.

The cell internal pressure transmitter 37 was ranged so that its pneumatic output signal of 3 to 15 psig was proportional to the expression 20.74 (0 to 72.3 psig). This signal is proportional to 20.74 $P_i$ in the equation above and is the "B" input to the computing relay 39.

The computing relay 39 solves the above equation by subtracting "B" from "A" and outputting a 3 to 15 psig signal "0" proportional to A-B, which is $P_h$-20.74 $P_i$ which is equal to $P_g$, 0 to 1500 psi. Thus, the signal from the computing relay is proportional to $P_g$ and the controller 40 set point was the desired $P_g$ and the controller maintained the desired $P_g$ by either increasing the pressure $P_h$ with the pump 34 or reducing the pressure $P_h$ with the bleed-off valve 35.

What is claimed is:

1. A process for controlling squeeze pressure load on gaskets in an electrolysis cell comprising:

a. determining a set value for the gasket pressure required for the cell and gasket geometry to provide a fluid-tight seal for the cell;

b. automatically comparing the internal pressure of the cell with the pressure of a compressing means for the cell, c. automatically activating a control means for adjusting the pressure of the compressing means for the cell to obtain the set value of the gasket pressure based on the data of step b.

2. The process of claim 1 wherein the electrolysis cell is a filter press-type cell.

3. The process of claim 1 wherein the compressing means is a hydraulic cylinder mounted on a mobile platen.

4. The process of claim 1 wherein step b is further carried out by measuring the internal cell pressure with a pressure sensing means and measuring the pressure of the compressing means with a pressure sensing means.

5. The process of claim 3 wherein the control means is activated in response to the pressure sensing means.

6. An apparatus for controlling the squeeze pressure load on gaskets in an electroysis cell comprising:

a. a means for determining a set value for the gasket pressure required for the cell and gasket geometry to provide a fluid-tight seal for the cell;

b. a means for automatically comparing the internal pressure of the cell with the pressure of a compressing means for the cell, c. a means for automatically activating a control means for adjusting the pressure of the compressing means for the cell to obtain the set value of the gasket pressure based on the data of step b.

7. The apparatus of claim 6 wherein the compressing means is a hydraulic cylinder mounted on a mobile platen.

8. The apparatus of claim 6 wherein the means for comparing the internal cell pressure with the compressing means pressure further includes a pressure sensing means for measuring the internal cell pressure and a pressure sensing means for measuring the pressure of the compressing means.

9. The apparatus of claim 6 wherein the control means is activated in response to the pressure sensing means.

10. An apparatus for controlling the gasket pressure in an electrolysis cell comprising a. a compressing means adapted for pressing cell members together, b. a pressure sensing means for measuring the pressure inside the electrolysis cell, c. a pressure sensing means for measuring the pressure in the compressing means d. an automatic control means for adjusting the pressure on the compressing means based on the measurements of step b and c so that the gasket pressure is equal to a preset value.

* * * * *

UNITED STATES PATENT AND TRADEMARK OFFICE

CERTIFICATE OF CORRECTION

PATENT NO. : 4,846,951

DATED : July 11, 1989

INVENTOR(S) : Gardner, Sr.

It is certified that error appears in the above-identified patent and that said Letters Patent is hereby corrected as shown below:

Col. 2, line 19; change "mesuring" to --measuring--.

Col. 3, line 25; change "activited" to --activated--.

Col. 3, line 50; change "variable" to --variables--.

Col. 4, line 11; change "assemblying" to --assembling--.

Col. 4, line 44; change "$P_g=P_h=20.74\ P_i$" to --$P_g=P_h-20.74\ P_i$--.

Col. 4, line 49; change "transmittter" to --transmitter--.

Col. 5, line 28; change "electroysis" to --electrolysis--.

Col. 6, line 27; insert a comma --,-- at the end of the line after "means".

Signed and Sealed this

Twenty-fifth Day of September, 1990

*Attest:*

HARRY F. MANBECK, JR.

*Attesting Officer*

*Commissioner of Patents and Trademarks*